US009646485B2

(12) United States Patent
El-Mankabady et al.

(10) Patent No.: US 9,646,485 B2
(45) Date of Patent: May 9, 2017

(54) LIVE PAGING SYSTEM AND METHODS OF USING THE SAME

(71) Applicant: SIEMENS INDUSTRY, INC., Alpharetta, GA (US)

(72) Inventors: Emad El-Mankabady, Monroe Township, NJ (US); Daniel S. Iasso, Towaco, NJ (US); Robert Limlaw, Boonton, NJ (US); Lester K. Perlak, Westfield, NJ (US); George E. Baker, III, Cedar Grove, NJ (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 14/851,549

(22) Filed: Sep. 11, 2015

(65) Prior Publication Data

US 2017/0076585 A1 Mar. 16, 2017

(51) Int. Cl.

| | |
|---|---|
| ***G08B 1/00*** | (2006.01) |
| ***G08B 27/00*** | (2006.01) |
| *G08B 1/08* | (2006.01) |
| *G08B 17/10* | (2006.01) |

(52) U.S. Cl.
CPC ..... *G08B 27/006* (2013.01)

(58) Field of Classification Search
CPC ..... G08B 27/006
USPC ..... 340/539.11
See application file for complete search history.

(56) References Cited

U.S. PATENT DOCUMENTS

| | | | | |
|---|---|---|---|---|
| 7,376,565 | B2 * | 5/2008 | Gandhi | G08B 1/08 704/274 |
| 8,917,186 | B1 * | 12/2014 | Grant | G08B 29/126 340/3.3 |
| 9,183,731 | B1 * | 11/2015 | Bokhary | G08B 25/10 |
| 2007/0146127 | A1 * | 6/2007 | Stilp | G08B 1/08 340/531 |
| 2012/0295567 | A1 * | 11/2012 | Tropper | H04W 4/14 455/404.1 |
| 2014/0253326 | A1 * | 9/2014 | Cho | H04W 4/22 340/539.13 |
| 2014/0340222 | A1 * | 11/2014 | Thornton | G08B 7/062 340/539.17 |

* cited by examiner

*Primary Examiner* — Jack K Wang

(57) ABSTRACT

Systems, methods, and devices for live paging from a mobile device in operable communication with a fire control panel are provided. Upon an occurrence of a stimulus activity at a fire control panel, e.g., an emergency event, an operator, remote from the fire control panel, may launch a control application from the mobile device. Upon launching the control application, a connection between the mobile device and the fire control panel may be established, and a microphone coupled to the mobile device may be activated for the operator to begin paging. The page may then be broadcasted in real-time via one or more annunciators operably connected to the fire control panel, or, as a recorded message.

20 Claims, 8 Drawing Sheets

LIVE PAGING SYSTEM AND METHODS OF USING THE SAME

TECHNICAL FIELD

The present disclosure relates generally to the field of emergency notification systems, and more particularly, to live paging from mobile devices of the emergency notification systems.

BACKGROUND

Typical fire safety systems include a number of safety field devices. For example, devices in a fire safety system may include fire and smoke detectors, pull stations, notification appliances or the like, positioned throughout an infrastructure for detecting an emergency event and notifying individuals of the emergency event. Notification appliances may include strobes, beacons, horns, speakers, displays or other notification devices or combination thereof for annunciating an alarm or emergency event. Safety devices are generally monitored and managed via a controller such as, for example, a fire alarm control panel (FACP). The FACP may receive from the safety devices information related to device status, location, and other information related to the respective devices. An operator/administrator may also be positioned at the FACP in order to receive and broadcast any event occurrences. For example, upon the occurrence of an emergency event (e.g., a fire), the operator/administrator is typically notified by one or more alarms/alerts from the safety devices via the FACP. Thereafter, the operator may use a microphone operatively connected to the FACP to announce/broadcast an audio message or live page pertaining to the emergency event to those who may be affected. In some instances, however, the operator may not have immediate access to the FACP's microphone, e.g., during a walk-through of an area remote to the FACP, and is therefore, unable to immediately broadcast the emergency event. This may cause an unwanted delay between the event occurrences and notifying those who will be affected, since the operator must return to the FACP to use the FACP's microphone to make the announcement. Therefore, there remains a need to provide operators with the ability to broadcast an audio message or live page pertaining to the occurrence of emergency events in instances where they are not physically at the FACP's microphone, and/or if the FACP microphone is not readily available.

SUMMARY

Various disclosed embodiments relate to systems and methods that may be employed in a live paging system to enable live paging from mobile devices via a control panel to notification devices in the live paging system.

In one embodiment, a fire control panel with paging capabilities is provided. The fire control panel may include a processor in signal communication with a memory and configured to execute a plurality of instructions of a control panel application stored in the memory and in response to an emergency event. Upon receiving an alert identifying the emergency event or indicative of the emergency event, the processor, under the control of the control panel application may be configured to generate a message identifying the emergency event, and transmit the message to a mobile device. Additionally, the fire control panel, under the control of the control application, may be configured to receive a reply message, via the mobile device, in response to the message, and determine whether the reply message identifies an audio file corresponding to the emergency event. The fire control panel, under the control of the control application may also be configured to broadcast, via one or more notification devices operably connected to the fire control panel, an audio signal in response to determining whether the reply message identifies the audio file.

In a further embodiment, a method in a control panel, e.g., a fire control panel, for broadcasting audio corresponding to an emergency event is described. The method includes the step of generating a message identifying an emergency event, and transmitting the message to a mobile device. The method further includes the step of receiving a reply message from the mobile device in response to the message, and determining whether the reply message identifies an audio file corresponding to the emergency event. The method also includes the step of broadcasting, via one or more notification devices operably connected to the control panel, an audio signal in response to determining whether the reply message identifies the audio file. Additionally, the method includes determining whether the reply message includes one or more credentials to authenticate that the mobile device is authorized to assume paging capabilities from the control panel prior to broadcasting the audio signal.

In another embodiment, a method in a mobile device for live paging in response to an emergency event is described. The method includes the step of receiving a message, via a control panel, identifying an emergency event. The method further includes the step of assuming paging capabilities from the control panel in response to the emergency event. In one embodiment, to assume paging capabilities from the control panel, the method may include the step of generating a reply message in response to the message and transmitting the reply message to the control panel. The reply message may include one or more credentials to authenticate that the mobile device is authorized to assume paging capabilities from the control panel. The method may further include the step of receiving an acknowledgement or second message, via the control panel, in response to the reply message, the second message authorizing the mobile device to assume paging capabilities. Additionally, the method may include the step of transmitting an identification of an audio file corresponding to the emergency event to the control panel for broadcasting of an audio signal corresponding to the identified audio file via one or more notification devices. In one embodiment, the identified audio file may be representative of an initial audio signal received via a microphone operably connected to the mobile device, or in a further embodiment, a pre-recorded message corresponding to the emergency event.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

The components and materials described hereinafter as making up the various embodiments are intended to be illustrative and not restrictive. Many suitable components and materials that would perform the same or a similar function as the materials described herein are intended to be embraced within the scope of embodiments of the present invention.

In general, the computing systems and devices described herein may be assembled by a number of computing components and circuitry such as, for example, one or more processors (e.g., Intel®, AMD®, Samsung®) in communication with memory or other storage medium. The memory may be Random Access Memory (RAM), flashable or non-flashable Read Only Memory (ROM), hard disk drives, flash drives, or any other types of memory known to persons of ordinary skill in the art and having storing capabilities. The computing systems and devices may also utilize cloud computing technologies, via the internet, to facilitate several functions, e.g., storage capabilities, executing program instructions, etc., as described in further detail below. The computing systems and devices may further include one or more communication components such as, for example, one or more network interface cards (NIC) or circuitry having analogous functionality, one or more one way or multi-directional ports (e.g., bi-directional auxiliary port, universal serial bus (USB) port, etc.), in addition to other hardware and software necessary to implement wired communication with other devices. The communication components may further include wireless transmitters, a receiver (or an integrated transceiver) that may be coupled or connected to broadcasting hardware of the sorts to implement wireless communication within the system, for example, an infrared transceiver, Bluetooth transceiver, or any other wireless communication know to persons of ordinary skill in the art and useful for facilitating the transfer of information. Additionally, a power supply/pack (e.g., hard wired, battery, etc.) may be included in any of the computing devices described herein. These power supplies may also include some form of redundancy or a backup power means known to persons of ordinary skill and for maintaining the functionality of the computing devices and/or components described herein.

Figure 1:
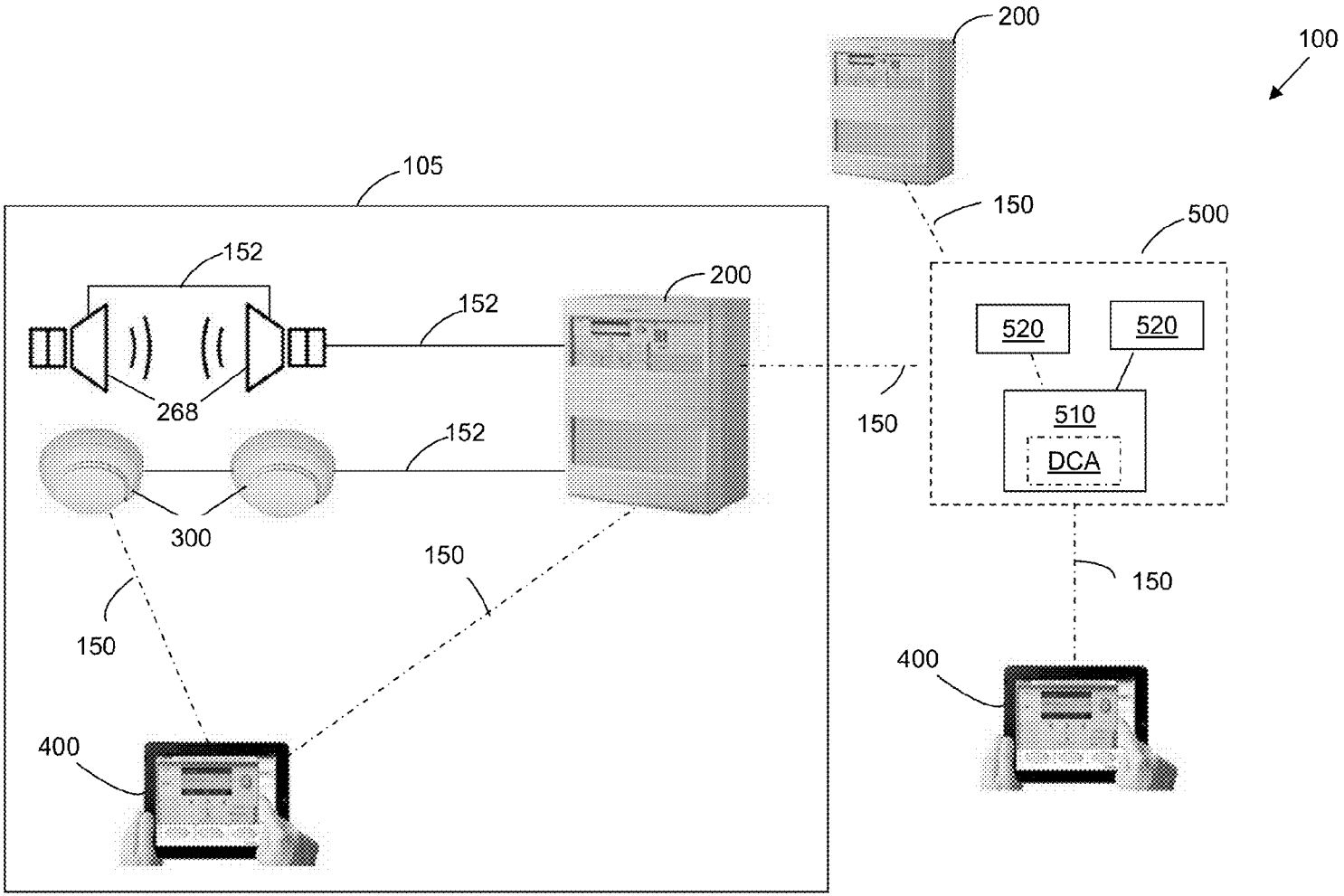
FIG. 1 illustrates an exemplary embodiment of a live paging system in accordance with the disclosure provided herein.

Referring now to the drawings wherein the showings are for purposes of illustrating embodiments of the subject matter herein only and not for limiting the same, FIG. 1 illustrates an embodiment of a live paging system 100, such as a fire alarm or safety system. The system 100 may include one or more control panels 200 operably connected to one or more safety field devices 300 (also referred to herein as an alarm device or a notification safety device), one or more mobile devices 400, and one or more data housing platforms (DHP) 500, e.g., cloud computing services.

In one exemplary embodiment, as illustrated in FIG. 1, the control panel 200, safety device 300, and mobile device 400 may be operably connected to each other within a defined area 105, e.g., a building or campus, via one or more electronically supervised audio paths or communications links 150, 152. The DHP 500 may also be operably connected to the control panel 200 and mobile device 400 via the electronically supervised audio paths or communications links, or may facilitate communication between multiple devices within the system 100, e.g., multiple control panels 200 via the communications link. The communications links may be, e.g., a wired communications link 152, wireless communications link 150, or any other communications link known to persons having ordinary skill in the art and configurable to allow for communication and/or interfacing between the devices and/or components of the system 100. Examples of such communication links may include Local Area Networks (LAN), Wide Area Networks (WAN), and Global Area Networks (GAN) having wired or wireless branches. Additionally, network devices/components and/or nodes (e.g., cabling, routers, switches, gateway, etc.) may also be included in the system 100 for facilitating the transfer of information within the system 100, and between at least the control panel 200, the one or more safety devices 300, the mobile device 400, or any devices that may be external to the system 100.

Figure 2A:
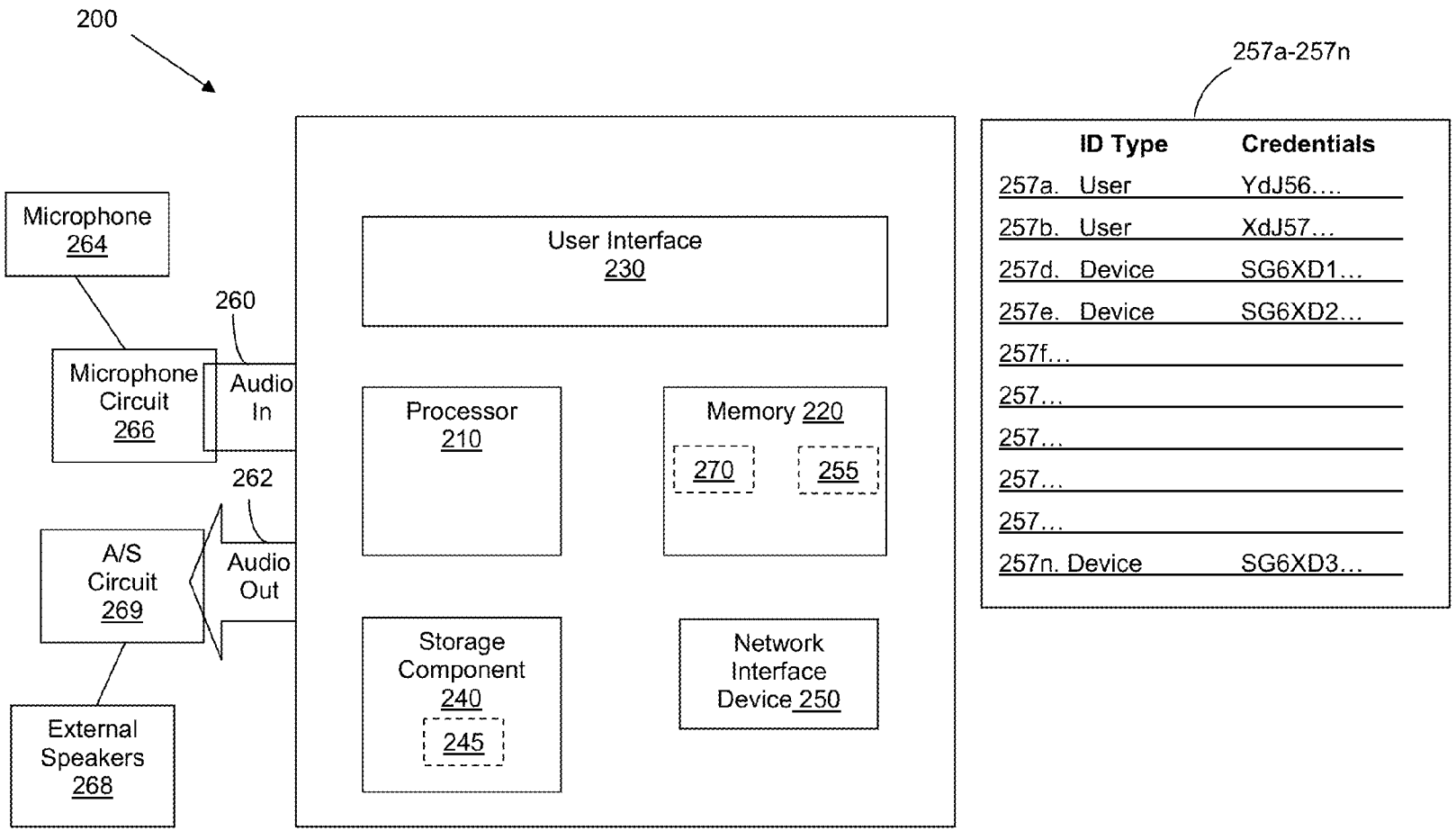
FIG. 2A illustrates an exemplary embodiment of a control panel that may be utilized in the system shown in FIG. 1, and in accordance with the disclosure provided herein.

With reference to FIG. 2, the control panel 200 may be, e.g., a fire alarm control panel or fire and voice control panel (FACP) 200, and may include any combination of the components and/or circuitry described above for facilitating the transfer of information within the system 100. In the embodiment of FIG. 2A, the FACP 200 includes, at least, a processor 210 operably connected to a memory 220 for executing various instructions and/or commands of a control application ("CAP") 270, which may be stored in the memory 220. The FACP 200 may further include a user interface 230, storage component 240 (e.g., hard disk drive, solid-state drive etc.), and network interface device 250. The network interface device 250 may be any of the communication components (e.g., NIC, wireless transceivers etc.) described herein for facilitating the transfer of information between the FACP 200 and other devices within the system 100, via, e.g., the communication links described herein. The user interface 230 may comprise a display with a separate or integrated keyboard and/or stylus that enables the processor 210 to provide outputs to and receive inputs from a user when under the control of the CAP 270. In a further exemplary embodiment, the user interface 230 may comprise a touch screen display that may be controlled and managed by the CAP 270. The touch screen display may have dual functionality for providing both an input means for receiving commands upon depressing the touch screen in any capacity, and an output or displaying means for displaying the results of the received/executed commands of the CAP 270.

The FACP 200 may further include one or more microphones 264 operably connected thereto via an audio input 260, and one or more notification or broadcasting devices, e.g., speakers 268, operably connected thereto via an audio output 262. In one embodiment, the audio input 260 and output 262 may be a single component, i.e., a single port having input/output (I/O) capabilities. In one embodiment, the microphones 264 may be connected to the audio input 260 via a microphone interface circuit 266 operable to receive and/or convert audio signals from the microphone 264 or similar device configured for transmitting audio signals to the FACP 200. The speakers 268 may also be connected to the audio output 262 via an amplifier and/or speaker interface circuit (A/S) 269 for facilitating the broadcasting of any audio from the FACP 200, or other devices configured for broadcasting audio, e.g., the mobile device 400.

In a further embodiment, the FACP 200 may include a proxy or gateway application (GA) 255 stored in the memory 220 and operable to establish a connection between the FACP 200 and other devices, e.g., the mobile device 400 and DHP 500 via the network interface device 250. The GA 255 may be its own application executed by the processor 210, or in a yet further embodiment, or series of instructions part of the CAP 270. In order to establish a connection, the GA 255 be operably configured to authenticate user credentials and/or verify system device information via a database or listing 245. In one embodiment, the listing 245 may be included in the GA 255, or in a further embodiment, requested or retrieved from in the FACP 200, e.g., via the storage 240 or memory 220. The listing 245 may include, for example, a list of mobile devices 400 authorized or registered with the FACP 200 for communicating with the FACP 200 via the gateway 255 for live page broadcasting to notification devices 268 and safety field devices 300 having an audio annunciator (such as a speaker) that are under the control of the FACP 200. Additionally, each entry of the listing 245 may include information corresponding to the fields 272*f*-272*i* of the user interface 230 (as depicted in FIG. 2B, for example) managed by the CAP 270 of the FACP 200.

During the authentication operation, for example, the processor 210 of the FACP 200, when under the control of the gateway 255, may receive an authentication request from a mobile device 400 over the communication link 150 for overriding paging of the FACP 200 by the requesting mobile device 400. The gateway 255 (alone or in cooperation with the CAP 270) may access the listing 245 to verify that the requesting mobile device is authorized and/or registered before providing an acknowledgment message to the requesting mobile device 400 indicating that it has no paging capabilities, has paging capabilities that are activated by the FACP 200 for override paging, or has paging capabilities that are currently deactivated by the FACP 200 for override paging.

With continued reference to the figures, the DHP 500 (FIG. 1) may include a data controller 510 operably connected to a data storage 520. The data storage 520 may be operably configured for storing any system data, including, e.g., data related to the events that may have occurred within the system 100. That is, the data storage may effectively provide the space necessary to archive any data related to the events, including the log files and corresponding audio files. The data controller 510 may include any combination of the components and/or circuitry described above for facilitating the transfer of information between, e.g., the data controller 510, the data storage 520, the FACP 200, or other devices within the system 100. For example, in one exemplary embodiment, the data controller 510 may include a processor operably connected to a memory for executing one or more instructions or commands of a control application (DCA) of the data controller 510. The DCA may be stored in the memory of the data controller 510, or other device operably connected thereto. In yet a further exemplary embodiment, the GA 255 may be a series of instruction of the DCA for authenticating user credentials and/or verify system device information via a database or listing 245. In this embodiment, access to the FACP 200 may be granted following authentication via the DCA, which may include the listing 245 stored in e.g., the data storage 520.

Figure 2B:
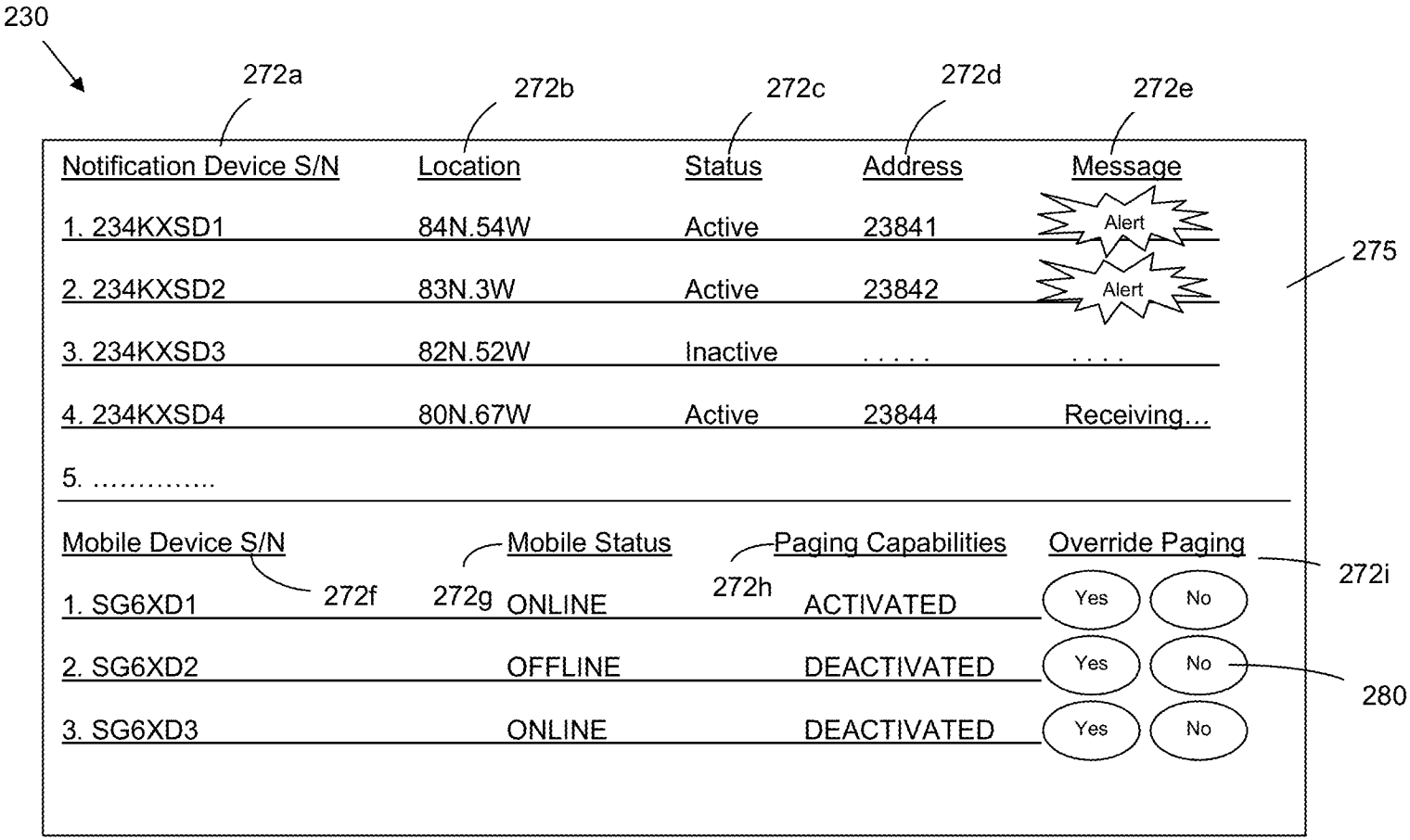
FIG. 2B illustrates an exemplary embodiment of a screen capture of a user interface generated and managed by a control application of the control panel of FIG. 2A.

With continued reference to the figures, and now FIG. 2B, an exemplary screen capture 275 of the user interface 230 generated via the CAP 270 in accordance with disclosed embodiments is provided. The user interface 230 may be a graphical user interface (GUI) generated by the CAP 270. The GUI may include one or more user selectable icons, which may be graphical symbols and/or include text (e.g., hyperlinks), corresponding to executable commands or instructions to be processed by the processor 210. The various commands may be activated and processed by the CAP 270 upon selection of the icons via the user interface 230. The user interface 230 may further include one or more fields (272) for displaying data from a database or other listing, e.g., having identification information corresponding to one or more devices within the system 100.

In the embodiment of FIG. 2B, e.g., the fields 272 of the user interface 230 may include a notification or safety field device serial number field 272*a*, a location field 272*b* for identifying the geographic coordinates for each device, a status field 272*c* for providing the status, e.g., active or inactive, for each device, an address field 272*d* that may identify the location of the device within the system 100, a message field 272*e* that may provide information related to the occurrence of an emergency event; a mobile device serial number field 272*f*, a second status field 272*g* indicating whether or not a particular mobile device or group of devices are online or offline, a paging field 272*h* corresponding to whether or not a respective mobile device's paging capabilities has been activated, and an override field 272*i* for providing an operator with the option to override the paging capabilities of the microphones 260 associated with the FACP 200. The override field 272*i* may further include one or more selectable icons 280, e.g., "yes" and "no" icons. The selectable icons 280 may be configured to trigger executable instructions for the processor 210 of the FACP 200, under the control of the CAP 270 (e.g., upon selection of the icon 280) to perform one or more operations corresponding to the fields 272. In operation, e.g., upon selection of the "yes" icon 280, under the override field 272*i*, the paging capabilities of any microphone(s) for the mobile devices 400 may be overridden, i.e., deactivated, and the paging capabilities may thereby be relinquished from the mobile device 400 to the FACP 200.

Figure 3:
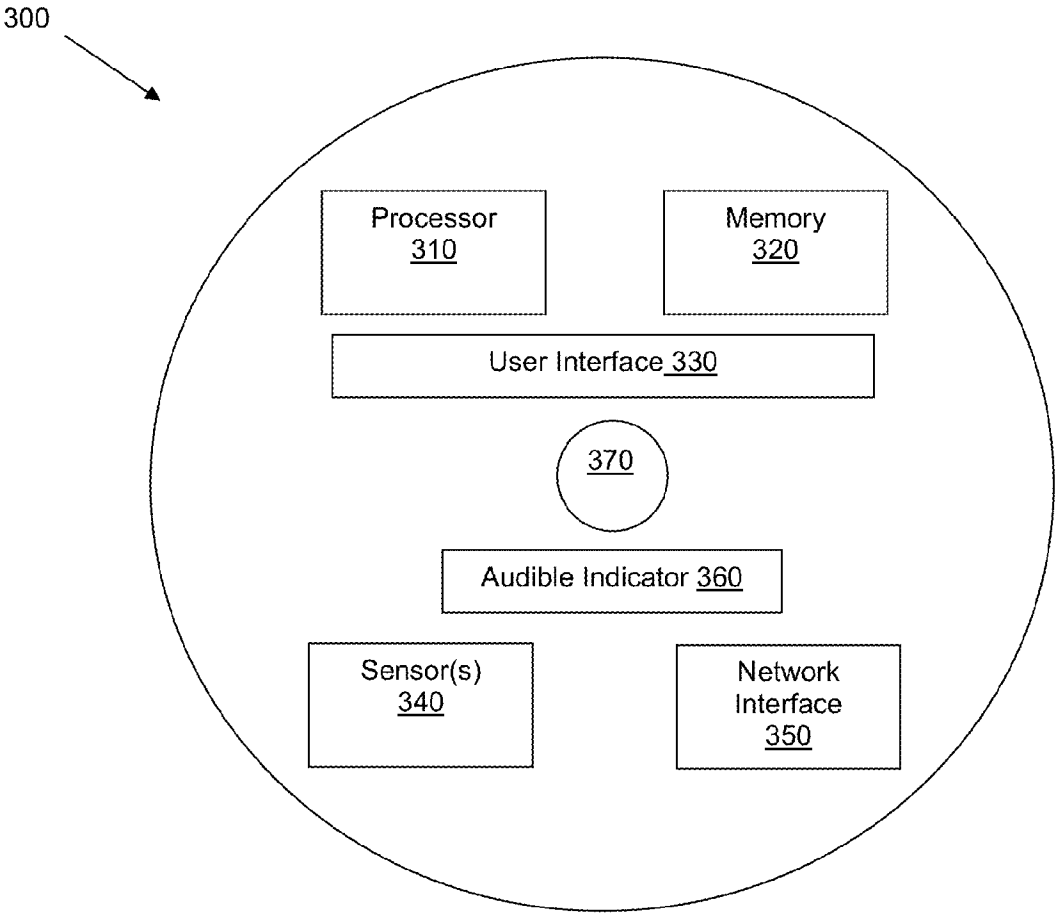
FIG. 3 illustrates an exemplary embodiment of a safety device for detecting an emergency event condition in accordance with the disclosure provided herein.

With reference to FIG. 3, an embodiment of the safety field device 300 that may be utilized in the system of FIG. 1 is shown. Similar to the control panel 200, the safety field device 300 may include any combination of the above circuitry and components to facilitate communication within the system 100, and for its operational purposes. The safety field device 300 may be configured to interface with the control panel 200 from which control and/or monitoring of the safety field devices 300 may be performed. Additionally, as previously disclosed, intervening devices and or components (e.g., routers, switches etc.) may be used to facilitate the transmission of information between the safety field device 300, control panel 200, and the mobile device 400. The safety field device 300 may be any number of devices, such as detectors (e.g., smoke), sensors, controllers (e.g., I/O devices, relays), pull stations, speakers etc., to detect, alert and control safety related concerns. As shown in FIG. 3, the safety field device 300 may include, at least, one or more processors 310, memory components 320, a user interface 330, sensors 340, and network interface components 350. The user interface 330 may be similar to the user interface 230 of the control panel 200 in that it may provide a means for transmitting commands to and from the devices within the system 100, for example, commands to and from the control panel 200 and/or the mobile device 400. Additionally, one or more network interface components 350 for facilitating the transfer of information may be included in the safety field device 300. The network interface components 350, or means for interfacing, may include any number of components operable for wired communication, e.g., NIC, USB, two wire fire control loop circuit, etc., or wireless communication (e.g., wireless transceiver, Infrared, Bluetooth, Wi-Fi, etc.), within the system 100, and between its devices, such as, the safety field device 300, the control panel 200, and/or the mobile device 400.

Figure 4:
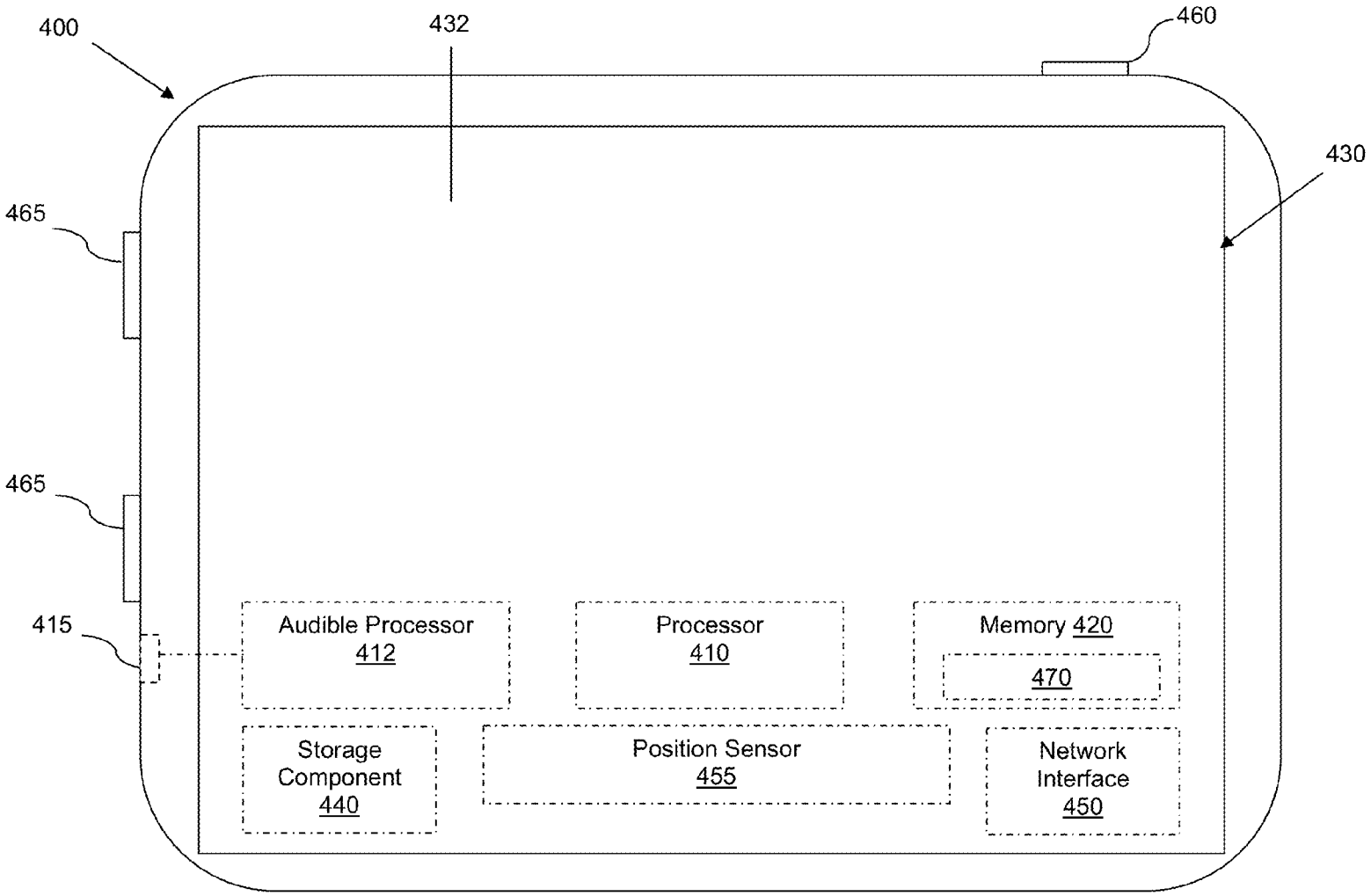
FIG. 4 illustrates an exemplary embodiment of a mobile device that may be utilized in the system shown in FIG. 1, and in accordance with the disclosure provided herein.

With continued reference to the figures, and now FIG. 4, an embodiment of the mobile device 400 that may be utilized in the system of FIG. 1 is shown. The mobile device 400 may be a hand held device, for example, a personal digital assistant (PDA), smart phone, tablet, notebook, or any device known to persons of ordinary skill in the art and having the hardware and software capability and configurability to provide a means for announcing and/or broadcasting an occurrence of an emergency event to notification devices 268 within the system 100 in accordance with disclosed embodiments.

The mobile device 400 may be configured to interface with the devices within the system 100, e.g., the control panel 200, safety field devices 300 and 268, either directly or via the DHP 500 (e.g., across the Internet). Similar to the control panel 200 and safety field device 300, the mobile device 400 may include any combination of the above circuitry and components to facilitate communication and the transmission of information within the system 100, and for its operational purposes. Additionally, the mobile device 400 may also include one or more operating systems such as, for example, Palm OS®, Microsoft® OS, Blackberry OS®, Symbian OS®, Mac OS®, I OS®, Android OS®, Linux OS® or any operating system known to persons of ordinary skill in the art and having the capabilities to execute programs for interfacing with the control panel 200, and other devices/nodes communicating within the system 100.

In the embodiment of FIG. 4, the mobile device 400 includes, at least, a processor 410 in signal communication with a memory 420, a user interface 430, a storage component 440, a network interface component 450, and an audio processor 412 operably connected to a microphone 415. The processor 410 may be operable to execute a plurality of instructions/commands from an embodiment of mobile alarm control application (MAC) 470 for facilitating the paging operation from the mobile device 400, and the transmission of information between the mobile device 400 and the FACP 200 directly (e.g., via a Bluetooth wireless protocol) and/or via the DHP 500 (e.g., via a standard TC/IP network protocol). The audio processor 412 may be configured to process audible signals from the microphone 415. In one embodiment, the audio processor 412 may, e.g., convert the signals into a file format compatible for use by FACP 200 or other devices within the system 100 or operably connected thereto. Additionally, the audio processor 412 may be configured to compress and/or split the audio files into sub-files, which may provide for faster or improved data transfer rates.

The microphone 415 may be integrated into the mobile device 400, or an external device operably coupled to the mobile device 400 via a wireless or wired interface, e.g., via the mobile port 465. It should also be appreciated that a wireless connection may also be established between the mobile devices via wireless protocols and/or transmitters discussed herein (e.g., Bluetooth, Infrared Sensor or the like). The audio processor 412 may capture and/or record via the microphone 415 one or more audio messages from the operator of the mobile device 400 and/or the areas surrounding of the microphone 415. In one embodiment, the microphone 415 may be activated to capture audio once the MAC 470 is launched on the mobile device 400. In another embodiment, the microphone may be activated upon selecting an icon representative of the microphone 415 via the MAC 470, the icon having corresponding executable instruction for activating the microphone 415. Additionally, the microphone 415 may be activated manually via, e.g., any application or selectable controls specific to the mobile device 400, or by any means known to persons having ordinary skill in the art.

Similar to the user interface 230, the user interface 430 may be any general interface for receiving user input and generating a displayable output on a display 432. In one embodiment, the user input may be the display 432, e.g., a touch screen display having dual functionality for providing an input means for receiving commands via at least a portion of the display 432, and a displaying means for displaying any results corresponding to any received/executed commands. In this embodiment, e.g., the touch screen display 432 may display one or more selectable icons generated by the MAC 470. Upon depressing at least a portion of the display 432 corresponding to the selectable icon of the MAC 270, the processor receives his selection or command to execute instructions corresponding to the selected icon, and subsequently display any results via at least a portion of the touch screen display 432. Other input means may include a keyboard, mouse, stylus or the like, connected to the mobile device 400 via the network interface component 450 (wired or wireless), or any means known to persons of ordinary skill in the art and capable of interfacing an input device/component with the mobile device 400.

The network interface component 450 may be similar to the network interface components of the safety field device 300 in that it is operable to facilitate communication within the system 100. For example, the network interface component 450 may be a wireless transceiver, or any components operable for wired or wireless communication within the system 100, and between its devices. The storage component 440 may be integrated into the mobile device (e.g., flash memory) or an external storage connected via the network interface component 450. Examples of external storages may be an external hard disc drive, cloud storage space, or other types of external storage devices known to persons of ordinary skill in the art and capable of being access in real-time by the mobile device 400.

The mobile device 400 may further include one or more mobile sensors 460, and one or more mobile ports 465 (e.g., analog, digital, audio, auxiliary ports etc.) having input/output capabilities. The mobile ports 465 may also have dual functionality, for sending and receiving information to any of the devices within the system 100. The mobile sensors 460 may also be configured to detect the status of the safety field device 300, and subsequently execute instructions for launching the MAC 470. For example, upon the occurrence of a building fire event, in addition to alerting the FACP 200 of the event, the safety field device 300 may simultaneously or subsequently alert the mobile device 400 of the event by broadcasting a signal sensible by the mobile sensor 460, which identifies the occurring event. The mobile sensor 460 may receive one or more signals from the safety field device 300 indicative of the event occurrence, and may subsequently cause the processor 410 to execute instructions or commands to launch the MAC 470. The mobile device 400 may further include a means for determining the position, or position sensor 455, such as a GPS device (e.g., a GPS receiver or Assisted GPS module), a navigation module or the like, or any transceiver or module known to persons of ordinary skill in the art for determining location coordinates.

In one embodiment, the MAC 470 may include a series of instructions for communicating with the position sensor 455 to determine the current position (e.g., longitudinal or latitudinal coordinates) of the mobile device 400, and for providing the coordinates to the FACP 200. The current position may subsequently be used to assist in executing emergency protocols, e.g., alerting and/or evacuating individuals and/or devices in and around the areas corresponding to the mobile device 400. Additionally, emergency personnel, e.g., firefighters, police, etc., may be notified and provided the position of the mobile device 400 to assist with the emergency protocols.

Figure 5:
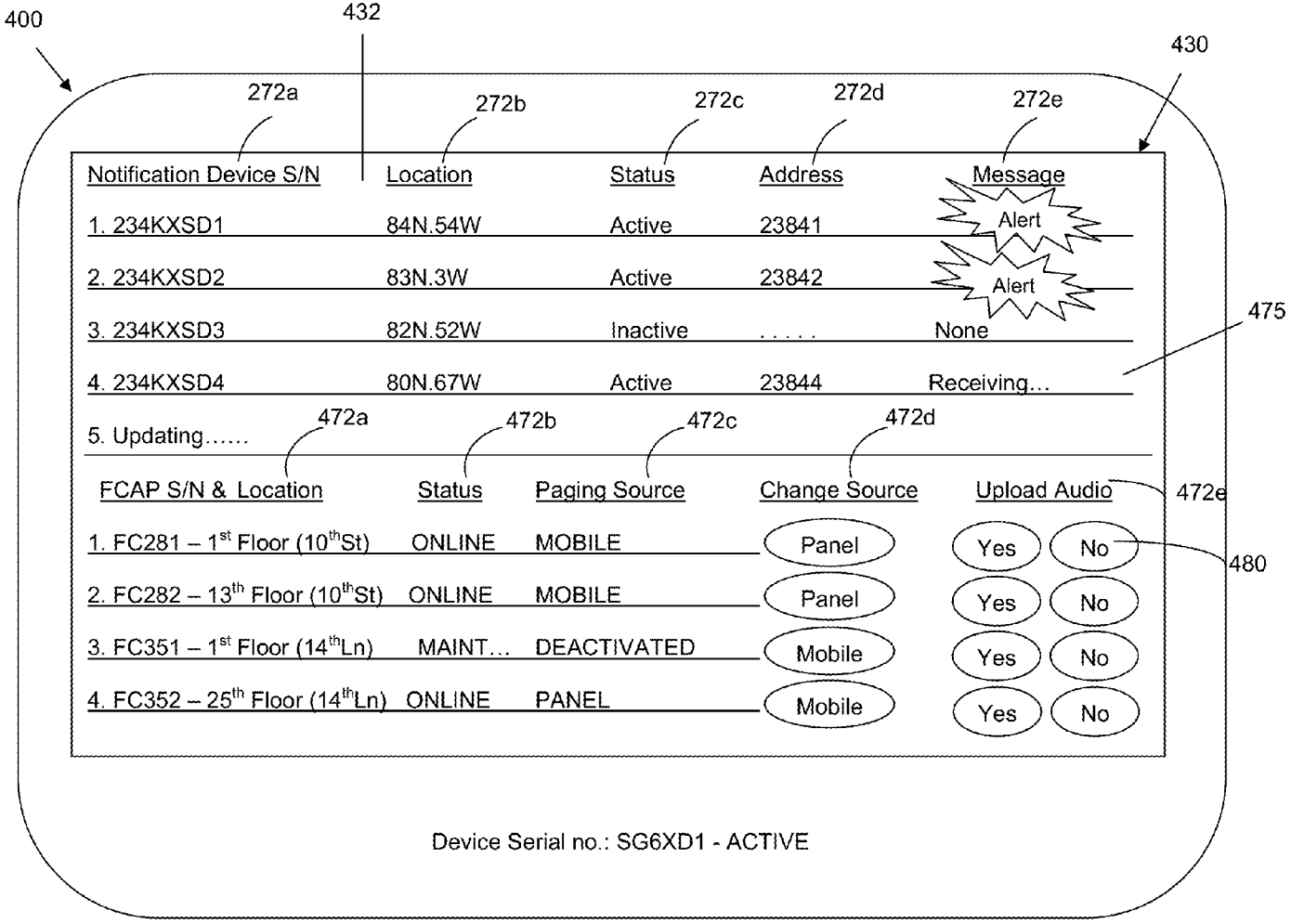
FIG. 5 illustrates an exemplary embodiment of a screen capture of a user interface generated and managed by a control application of the mobile device of FIG. 4, and in accordance with the disclosure provided herein.

With continued reference to the figures, and now FIG. 5, an illustration of a screen capture of an interactive interface (i.e., screen 475) generated and displayed by the MAC 470 is shown. In one embodiment, upon launching the MAC 470, one or more input fields may be provided for receiving characters and/or authentication information corresponding to the operator of the mobile device 400, or any authorized user. In one embodiment, upon entering the authentication information, the processor 210 under the control of the MAC 470 send a first message including the authentication information and an identifier of the mobile device 400 (e.g., mobile device serial number or mobile subscription identification number) to the FACP 200 hosting the GA 255, or in a further embodiment, via one or more controllers 510 of the DHP 500 hosting the DCA for verification that the mobile device 400 is registered with the FACP 200 for live paging override to one or more notification devices 268 in the system 100. The processor of the FACP 200, under the control of the GA 255, may receive the first message from the mobile device 400, parse the first message to determine the identifier of the mobile device 400 and determine (alone of in cooperation with CAP 270) if mobile device 400 identifier is among the list of mobile devices 400 registered with the FACP 200 as shown in the list reflected by field 272*f* of the user interface 230 of the FACP 200 in FIG. 2B.

The MAC 470 may also generate one or more selectable icons and/or links, which upon selection of the icons, various commands may be executed. For example, selecting an icon representative of the microphone 415 may execute instructions to activate the microphone 415 so that the operator may begin announcing the event occurrence. Additionally, selecting the same icon multiple times may deactivate the microphone 415. Additional icons may also be provided for deactivating the microphone 415. The MAC 470 may also generate icons for sending an audio file or begin streaming any live audio to the other devices in the system 100, e.g., FACP 200, or for uploading any recorded audio files, e.g., to the DHP 500 or any other devices configured to handle or manage audio files known to persons having ordinary skill in the art.

With continued reference to the FIG. 5, the screen 475 may depict various fields that may be similar to the fields of the CAP 270. For example, fields corresponding to the notification device 268 or safety field device with audio annunciator 300 may include the device serial number field 272*a*, location field 272*b*, status field 272*c*, address field 272*d*, and message field 272*e*. Additional fields corresponding to other devices, e.g., the FACP 200 may also be provided by the MAC 470. These fields may include, e.g., a FACP serial number and location field 472*a* that may display the FACPs 200 within the system 100 and where they may be physically located, a status filed 472*b* identifying whether or not the FACP 200 is online, offline, or undergoing any maintenance, a paging source field 472*c* which may identify which device is in control of the paging capabilities as it corresponds to a particular FACP 200. A change source field 472*d* may also be provided, and may include one or more selectable icons corresponding to executable instructions operable to change the paging source upon selection of the icon. For example, if the paging source is provided at the FACP 200, the operator of the mobile device, may select a "mobile" icon to switch control of the paging capabilities from the FACP 200 to the mobile device 400, or vice versa. An upload audio field 472*e* may also be provided, which may include one or more selectable icons 480 corresponding to executable instructions operable to facilitate the uploading of any recorded audio file, or to facilitate streaming a live broadcast from the mobile device 400. It should also be appreciate that the live streaming and/or uploading functionality may be automated, i.e., executed without user intervention, once the microphone 415 is activated on the mobile device 400. The information displayed in the fields 472 may be populated and/or queried from a database or listing (not shown) having device specific information for the devices registered within the system 100, and that may be authorized to access the system 100. In an embodiment where a list is provided, the MAC 470 may include a series of instructions for requesting or accessing the list the FACP 200 and/or the DHP 500. In an embodiment where the information is provided via the database having device information, the MAC 470 may include a series of instruction for generating a query and requesting the device information from the database and based at least on the query.

Figure 6:
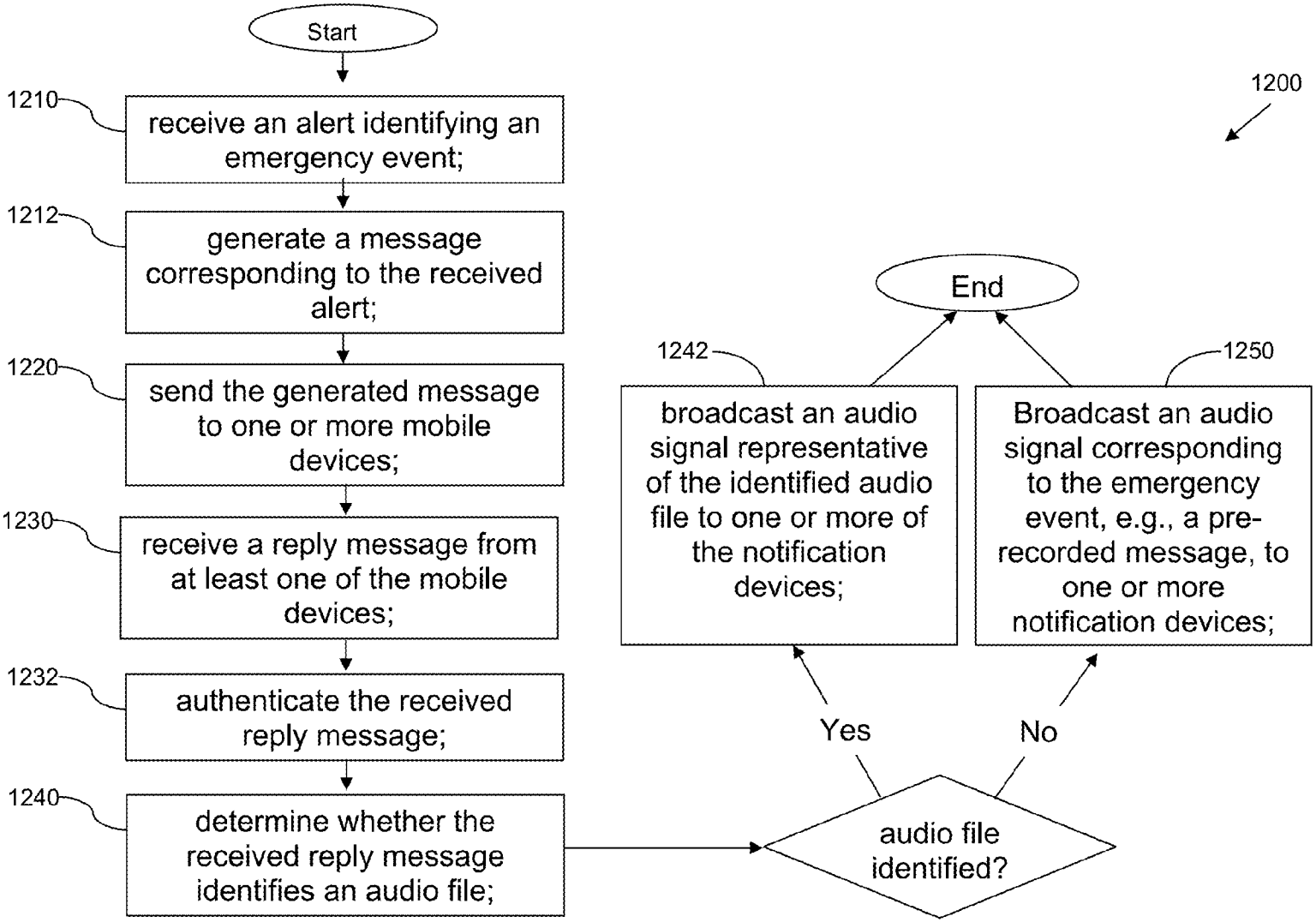
FIG. 6 illustrates an exemplary flowchart of a process performed by the fire control panel of FIG. 2 in accordance with the disclosure provided herein.

With continued reference to the figures, and now FIG. 6, an exemplary flowchart is shown of a process 1200 performed by the FACP 200, under the control of the CAP 270 for live paging in the system 100 in accordance with the disclosed embodiments. Upon the occurrence of an emergency event, e.g., smoke or fire present in a building, the safety field device 300 detects the event and may generate an alarm signal or alert indicative of the occurrence. The alert may include, among other things, the address and location of the safety field device 300, the time when the safety field device 300 was activated, and the type of conditions being detected.

In the process 1200 depicted in FIG. 6, the FACP 200 receives the detected alert from the safety field device 300 via a communication link 150 between the FACP 200 and the respective safety field device 300 (1210). The FACP 200 generates a message identifying an emergency event corresponding to the received alert (1212). In one embodiment, the emergency event may be the alert (e.g., alarm signal received from the respective safety field device 300). Alternatively, the emergency event may be pre-defined message assigned to any alert received from a respective safety field device 300 (e.g., fire detected in room corresponding to the location of safety field device 300 that transmitted the alert to the FACP 200). Next, the FACP 200, under the control of the CAP 270, may send the emergency event message, via the gateway 255, to one or more mobile devices 400 registered with the FACP 200 (1220). In one embodiment, the FACP 200 may send the emergency event message to at least the mobile device 400 that is registered with the FACP 200 for live paging and that is currently activated for overriding paging by the microphone 264 of the FACP 200.

The processor 210 of the FACP 200, under the control of the CAP 270, may determine which mobile devices 400 are registered by accessing a list 257*a*-257*n* (FIG. 2A) of registered mobile devices 400 stored in memory 220.

In one embodiment, the emergency event message may include general information related to the notification devices 268 within the system 100, and preferably, the notification devices 268 that may receive and broadcast a live page audio signal (such as an audio file or a streaming audio signal). The general information related to the notification devices 268 may correspond to the fields 270 of the user interface 230 managed by the CAP 270 of the FACP 200. Such general information of the notification devices 268 may be stored in memory 220 of the FACP 200 for access by the CAP 270. In a further embodiment, the emergency event message may include mapping information for the location of such notification devices 268 within the system 100 so that an operator of a mobile device 400 that is registered and activated for paging within the system 100 may selectively identify which of the notification devices 268 should receive a live page audio signal from the operator via the respective mobile device 400 as further described herein.

In yet a further embodiment, the emergency event message or subsequent message generated by the FACP 200 under the control of the CAP 270 for transmission may include a series of executable instructions for controlling or enabling features of the mobile devices 400 associated with live paging to the notification devices 268 in the system 100 via the FACP 200. The series of instructions in the emergency event message may be executed via the respective receiving mobile device's processor under the control of the MAC 470 of the mobile device. The controlled features may include, e.g., causing the safety field device 300 to activate their audible or visual indicators for alerting others about the conditions.

In one embodiment, the instructions for controlling or enabling features include a live paging activate command that causes the processor of the mobile device 400 to launch or start the MAC 470 and, to automatically generate the user interface 230 with the fields 272*a*-272*e*, 472*a*-472*e* and selectable upload audio icons 480. In this embodiment, the operator using the mobile device 400 as a responder need only announce the emergency event without launching or logging into the MAC 470 of the mobile device 400 so that the processor of the mobile device 400, under the control of the MAC 470, causes the MAC 470 to generate and transmit the responder's announcement of the emergency event to the FACP 200 for broadcast through pre-defined or selected notification devices 268.

Continuing with the process 1200 as shown in FIG. 6, the FACP 200 receives, via the gateway 255, an authentication request message (also referenced as a page request message or reply message) from a mobile device 400 over the communication link 150 for overriding paging via microphone 264 of the FACP 200 (1230). In one embodiment, the page request message may include a live announcement audio file or segment corresponding to the emergency event transmitted by the FACP 200, (e.g., the audio file or segment may be audio being streamed from the mobile device 400 in real-time). In a further embodiment, the page request message may include a data file that includes data corresponding to the emergency event, e.g., an audio data file from the mobile device 400. In an alternative embodiment, the page request message may identify an audio file (e.g., a pre-recorded audio message) that is stored on the FACP 200 to signal to the FACP 200 to broadcast the identified audio file or pre-recorded audio message.

After receiving the authentication request or reply message, the FACP 200 under the control of the CAP 270 determines whether the received reply message is from one of the mobile devices registered with the FACP 200 (1232). In one implementation, the CAP 270 determines the reply message is from a registered mobile device 400 by locating the identifier of the mobile device 400 in the received message (where such identifier corresponds to a user credential for user authentication) and comparing the identifier of the mobile device 400 to the list 257*a*-257*n* of mobile devices 400 registered with the FACP 200. If it is determined the received reply message is not from one of the mobile devices registered with the FACP 200, the CAP 270 may continue processing at step or act 1210 in order to detect and transmit further alerts corresponding to subsequent emergency events and to process any other received reply messages. By performing the action(s) identified in 1232 of the process 1200, the FACP 200 advantageously inhibits users of unregistered mobile devices from overriding the microphone 264 of the FACP 200 to unauthorized broadcast audio messages. If it is determined that the received reply message is from one of the mobile devices registered with the FACP 200, the FACP 200 under the control of the CAP 270 determines if the one mobile device 400 has been activated for paging via the FACP 200.

In one implementation, the CAP 270 determines the one mobile device 400 has been activated for paging via the FACP 200 by accessing the paging capability corresponding to field 272*h* of the one mobile device 400 as stored in memory 220 in relation to the identifier field 272*f* for the one mobile device 400. If it is determined that the one mobile device 400 has not been activated for paging, the CAP 270 may send a denial reply message back to the one mobile device 400 via the gateway 255 before continue processing at step or act 1210 in order to detect and transmit further alerts corresponding to subsequent emergency events and to process any other received page request messages. If it is determined that the one mobile device 400 has been activated for paging, the CAP 270 further parses the received request message for data associated with the requested page to determine whether the received reply message identifies an audio file, which may correspond to a pre-recorded audio message stored on the FACP 200 or an audio file or segment being streamed as recorded by the respective mobile device 400 that is included in the reply message (1240). If it is determined that the received request message identifies an audio file or segment, the FACP 200 under the control of the CAP 270 transmits (via the A/S interface circuit 269) an audio signal corresponding to the audio file to one or more of the notification devices 268 in the system 100 (1242). Where the identified audio file corresponds to a pre-recorded audio message stored on the FACP 200, the FACP 200 retrieves the respective pre-recorded audio message as the audio file to be used in generating and transmitting the corresponding audio signal to the notification devices 268 in step 1242.

The FACP 200 under the control of the CAP 270 may process (e.g., modify and reformat) the audio file or segment to generate the corresponding audio signal before broadcasting the audio signal via the one or more notification devices within the system 100. In one embodiment, the FACP 200 under the control of the CAP 270 identifies the one or more notification devices 268 to be sent the audio signal corresponding to the received audio file or segment from the respective mobile device 400 by further parsing the received request message to locate any notification device identifiers (e.g., serial number corresponding to field 272*a*) and transmitting the audio signal only to the notification devices 260 identified in the received request message. In another embodiment, the FACP 200 under the control of the CAP 270 identifies the one or more notification devices 268 to be sent the audio signal based on pre-defined rules, such as based on a pre-defined proximity of each notification device 268 to the location of the safety field device 300 that transmitted the alert corresponding to the emergency event to the FACP 200.

If it is determined that the received request message does not identify an audio file or segment, the FACP 200 under the control of the CAP may transmit a pre-recorded or canned audio message corresponding to the emergency event (rather than an identified audio file from the mobile device) to the one or more notification devices 268 in response to receiving the request message from the one mobile device 400 (1250). This pre-recorded or canned audio message may be repeatedly broadcasted by the FACP 200 until an audio file or segment is received in a subsequent page request message from the mobile device 400, another audio file is identified in a subsequent page request message from the mobile device 400 that identifies a different pre-recorded audio message stored on the FACP 200, and/or until the current emergency event has been downgraded or concluded. After transmitting an audio signal to the one or more notification devices 268 based on the received request message from the one mobile device 400, the FACP 200 under the control of the CAP 270 may end processing or continue processing at step or act 1210 in order to detect and transmit further alerts corresponding to subsequent emergency events and to process any other received page request messages.

Figure 7:
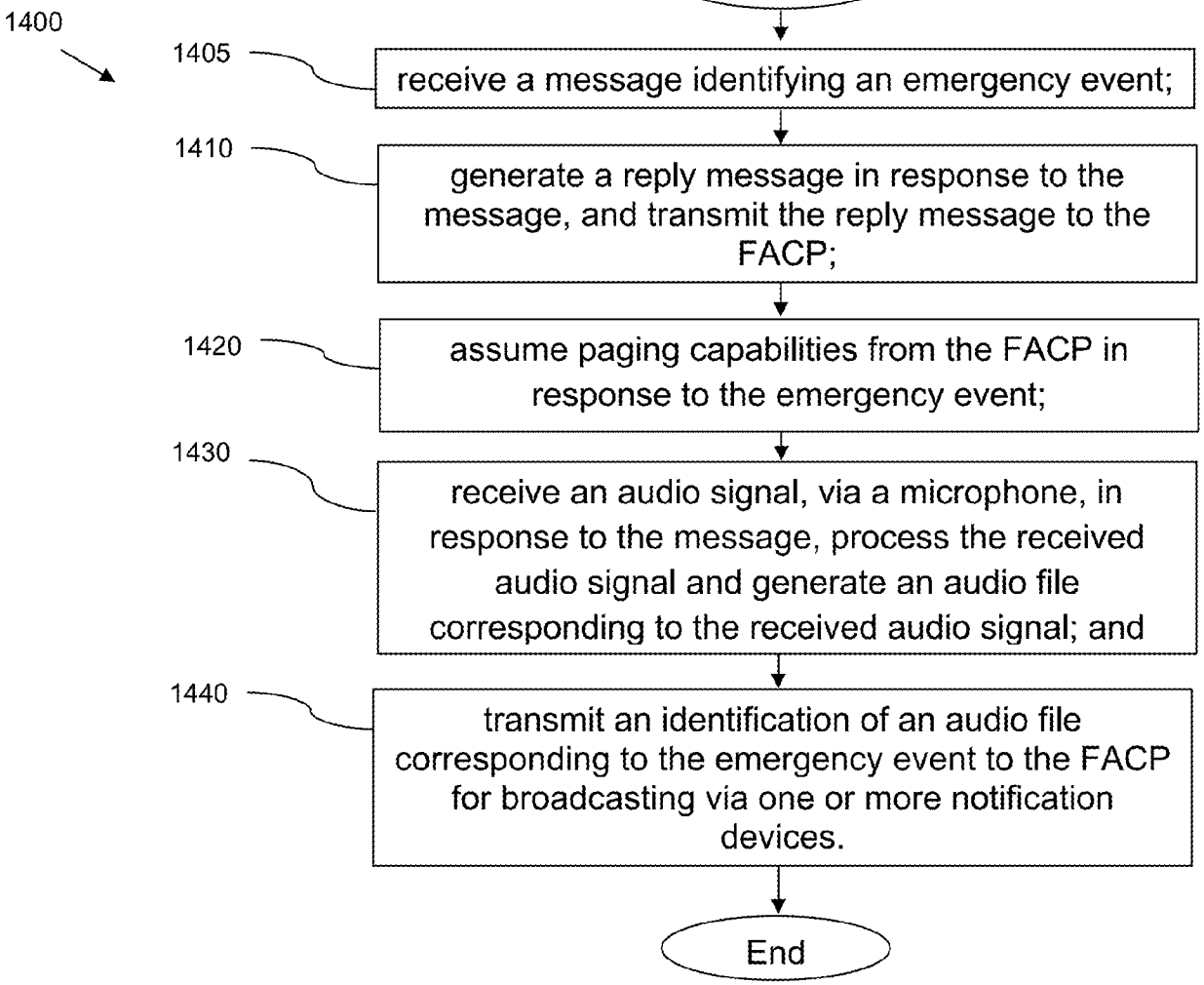
FIG. 7 illustrates an exemplary flowchart of a process performed by the mobile device of FIG. 4 in accordance with the disclosure provided herein.

FIG. 7 illustrates an exemplary flowchart of a process 1400 performed by the mobile device 400, under the control of the MAC 470, for live paging in the system 100 in accordance with disclosed embodiments. In this process, the mobile device 400 receives a message identifying an emergency event occurrence from one or more devices within the system 100, e.g., the FACP 200 (1405). After receiving the message from the FACP 200, the mobile device 400, under the control of the MAC 470, may generate a reply message in response to the message for transmit to the FACP 200 or other device, and may transmit the reply message to the FACP 200 (1410). The reply message may include authentication information (e.g., user credentials such as a mobile device 400 ID) for verifying that the user or mobile device 400 is authorized to establish a connection with the FACP 200. In an embodiment where user credentials are used for establishing a connection with the FACP 200, the MAC 470 may generate a login page with input fields for receiving the credentials. Following the transmission of the credentials to the FACP 200, the credentials may be verified by comparing the values of the credentials with a database or listing having user/device information, e.g., the list 257*a*-257*n*. The authentication process may further include the use of a proxy or gateway application (e.g., GA 255, DCA) to facilitate establishing the connection between the mobile device 400 and the devices within the system 100, e.g., the FACP 200 or DHP 500. Upon authenticating the user or mobile device 400, a connection may be established between the mobile device 400 and the FACP 200 via the gateway 255. Upon establishing the connection between the mobile device 400 and FACP 200, the mobile device 400 may assume paging capabilities from the FACP 200 (1420). In one exemplary embodiment, the paging capabilities may be assigned to the mobile device via the initial message from the FACP 200, or in a further exemplary embodiment, upon authenticating the mobile device 400. In yet a further exemplary embodiment, the mobile device 400, under control of the MAC 470, may also transmit a request for paging control with the reply message or any subsequent messages in response to the message from the FACP 200.

It should be appreciated that the microphone 415 may be activated in combination with any of the above steps, e.g., step 1420, or its own step prior to the operator's paging. Upon receiving paging control, the MAC 470 may generate a user interface, e.g., a GUI, displayed via the display 432, which may provide the operator with information corresponding to the emergency event (e.g., type of event, location etc.), in addition to, e.g., one or more selectable icons corresponding to instructions for paging, e.g., stream audio, record audio, and upload audio. Upon selection of one of the icons, e.g., stream audio icon, the instructions of the MAC 470 corresponding to the icon may cause the processor 410 to execute instructions to begin receiving and/or processing one or more audio signals from, e.g., the microphone 415 (1430). For example, the operator may depress the stream audio icon via the touch screen display 432, and begin paging via the microphone 415. The series of instructions of the MAC 470 corresponding to the processing of the live page audio may include instructions for converting the file into a format compatible with the FACP 200 for streaming at least a portion of the audio data file in real-time. Additionally, instructions for compressing and/or splitting the audio file into multiple smaller sized files for transmitting the same to the FACP 200 in real-time may be included in the MAC 470. After processing the audio signals from the microphone 415, the mobile device 400 under the control of the MAC 470 may then transmit an identification of an audio file representative of the emergency event in real-time to the FACP 200 for broadcasting via one or more speakers 268 or annunciators (1440). In one embodiment, identified audio file may be representative of the audio signals from the microphone 415, or in a further embodiment, the identified audio file may be representative of a pre-recorded audio message. It should also be appreciated that the identified audio file, e.g., the pre-recorded audio message, may be stored on the mobile device 400 and provided to the FACP 200 with the reply message or any other message from the mobile device to the FACP 200, or in another embodiment, the identified audio file may be stored on another device within the system 100, e.g., FACP 200, data controller 510, or data storage 520, and made accessible to the FACP 200 for broadcasting via that device.

With continued reference to FIG. 7 and process 1400, in an embodiment where the operator elects to record the audio versus streaming the page, upon selecting the record audio icon, an audio data file resulting from the operator's page may be generated, store locally, e.g., via the storage component 440, and subsequently transmitted to the FACP 200 following the conclusion of the page. To determine whether the page has concluded, the MAC 470 may include instructions for detecting whether audio signals are being processed via the audible processor 412, or being received via the microphone 415. These audio signals may be indicative of whether the operator has concluded the page via the microphone 415. If no audio is received via the microphone 415, or processed via the audible processor 412, a MAC 470 may determine that the page has concluded, and may cause the processor 410 to begin processing any present audio signals. Following the processing of the audio signals, if needed, the audio data file may be transmitted to the FACP 200 for broadcasting via the speakers 268 or other annunciators operably connected to the FACP 200. Upon successful transmission of the audio data file from the mobile device to the FACP 200, or upon the successful broadcasting of any audio via the annunciators, the connection between the mobile device 400 and the FACP 200 or DHP 500, e.g., in an embodiment where the audio file is communicated to the FACP 200 via the DHP 500, may be closed, and the mobile device 400 may relinquish paging capabilities back to the FACP 200, which may also cause the microphone 415 to deactivate.

While specific embodiments have been described in detail, those with ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the terms "comprising", "including", and "having", are open-ended and does not exclude other elements or steps and the use of articles "a" or "an" does not exclude a plurality. Additionally, the steps of various methods disclosed herein are not required to be performed in the particular order recited, unless otherwise expressly stated.

We claim:

1. A fire control panel with paging capabilities comprising:

a processor in signal communication with a memory and configured to execute a plurality of instructions of a control panel application stored in the memory and in response to an emergency event;

wherein upon receiving an alert indicative of the emergency event, the processor, under the control of the control panel application, is configured to:

generate a message identifying the emergency event;

transmit the message to a mobile device;

relinquish the paging capabilities to the mobile device;

receive a reply message, via the mobile device, in response to the message;

determine whether the reply message identifies an audio file corresponding to the emergency event and resulting from the relinquished paging capabilities; and broadcast, via one or more notification devices operably connected to the fire control panel, an audio signal in response to determining whether the reply message identifies the audio file.

2. The fire control panel of claim 1, wherein the reply message includes the audio file; and wherein the broadcasted audio signal is representative of the identified audio file.

3. The fire control panel of claim 2, wherein the identified audio file is representative of audio received via a microphone operably connected to the mobile device.

4. The fire control panel of claim 2, wherein the identified audio file is representative of a pre-recorded audio message.

5. The fire control panel of claim 1, wherein upon transmitting the message to the mobile device, the fire control panel receives authentication information, and wherein the processor, under the control of the control application, is further configured to:

determine whether the authentication information identifies the mobile device as authorized to assume paging capabilities from the fire control panel prior to broadcasting the audio signals.

6. The fire control panel of claim 5 further comprising:

a storage device that includes a listing of users or devices authorized to assume paging capabilities from the fire control panel; and wherein, the processor, under the control of the control panel application, verifies the one or more credentials by comparing the one or more credentials with the listing.

7. The fire control panel of claim 1, wherein the fire control panel, under the control of the control panel application, is further configured to: deactivate a microphone operably connected to the fire control panel upon relinquishing paging capabilities.

8. A method in a control panel for broadcasting audio corresponding to an emergency event, comprising the steps of:

generating a message indentifying an emergency event;

transmitting the message to a mobile device;

relinquishing paging capabilities to the mobile device;

receiving a reply message from the mobile device in response to the message;

determining whether the reply message identifies an audio file corresponding to the emergency event and resulting from the relinquished paging capabilities; and broadcasting, via one or more notification devices operably connected to the control panel, an audio signal in response to determining whether the reply message identifies the audio file.

9. The method of claim 8, wherein the reply message includes the audio file; and wherein the broadcasted audio signal is representative of the audio file.

10. The method of claim 9, wherein the identified audio file is representative of audio received via a microphone operably connected to the mobile device.

11. The method of claim 9, wherein the identified audio file is representative of a pre-recorded audio message.

12. The method of claim 8, wherein the step of transmitting the message to the mobile device comprises:

receiving authentication information from the mobile device and determining whether the authentication includes one or more credentials identifying the mobile device as authorized to assume paging capabilities from the control panel prior to broadcasting the audio signal.

13. The method of claim 12 further comprising, verifying the one or more credentials by comparing the one or more credentials with a listing of authorized users or devices.

14. The method of claim 12 further comprising:

deactivating a microphone operably connected to the control panel upon assigning the paging capabilities to the mobile device.

15. A method in a mobile device for live paging in response to an emergency event, comprising the steps of:

receiving a message, via a control panel, identifying an emergency event;

assuming paging capabilities relinquished from the control panel in response to the emergency event; and transmitting an identification of an audio file corresponding to the emergency event to the control panel for broadcasting of an audio signal corresponding to the identified audio file to one or more notification devices.

16. The method of claim 15, wherein assuming paging capabilities from the control panel further comprises:

generating a reply message in response to the message, the reply message including one or more credentials to authenticate that the mobile device is authorized to assume paging capabilities from the control panel; and transmitting the reply message to the control panel.

17. The method of claim 16, wherein assuming paging capabilities from the control panel further comprises:

receiving a second message, via the control panel, in response to the reply message, the second message authorizing the mobile device to assume paging capabilities.

18. The method of claim 15 further comprising:

receiving an initial audio signal corresponding to the emergency event, via a microphone operably connected to the mobile device; and generating the audio file to represent the initial audio signal.

19. The method of claim 15, wherein the audio file is representative of a pre-recorded audio message.

20. The method of claim 15 further comprising:

relinquishing paging capabilities to the control panel upon successful broadcasting of the audio signal.

* * * * *